US006048437A

United States Patent [19]

Fukushima et al.

[11] Patent Number: 6,048,437

[45] **Date of Patent: *Apr. 11, 2000**

[54] PROCESS FOR BLEACHING CHEMICAL PULP WITH CHLORINE DIOXIDE, PEROXIDE AND $NA_2M_0O_4$ AS REACTION CATALYT

[75] Inventors: Takamasa Fukushima; Tetsuo Koshitsuka; Yuh Miyauchi; Akiyo Shimada; Takahiro Cho, all of Tokyo, Japan

[73] Assignee: Mitsubishi Gas Chemical Company, Inc., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/716,034

[22] Filed: Sep. 19, 1996

[30] Foreign Application Priority Data

Sep. 22, 1995 [JP] Japan ..... 7-244268
Apr. 17, 1996 [JP] Japan ..... 8-095578

[51] Int. Cl.[7] ..... D21C 9/14; D21C 9/16

[52] U.S. Cl. ..... 162/78; 162/79; 162/88; 162/89

[58] Field of Search ..... 162/78, 79, 67, 162/88, 89, 65, 87

[56] References Cited

U.S. PATENT DOCUMENTS 3,865,685 2/1975 Hebbel et al. ..... 162/88
4,410,397 10/1983 Kempf ..... 162/78
4,427,490 1/1984 Eckert ..... 162/78
4,661,205 4/1987 Ow ..... 162/78

FOREIGN PATENT DOCUMENTS 658488 2/1963 Canada ..... 162/78
94/05851 2/1994 WIPO ..... 162/78

*Primary Examiner*—Steven Alvo
*Attorney, Agent, or Firm*—Frishauf, Holtz, Goodman, Langer & Chick, P.C.

[57] ABSTRACT

A process for bleaching chemical pulp for paper manufacturing comprising delignifying and bleaching chemical pulp which has been treated by cooking by simultaneous use of chlorine dioxide, a peroxide, and at least one reaction catalyst selected from the group consisting of oxoacids of elements of Groups IV, V and VI and salts of these acids. Formation of organic chlorine compounds as by-products is suppressed by decreasing the amount of chlorine dioxide used in the ECF bleaching process in the first stage, and thus environmental toxicity in the waste water discharged from the bleaching process is decreased. Chemical pulp having a high degree of brightness is economically produced because increase in the production capacity is not required at all or suppressed to the minimum, and the investment cost is reduced to the minimum when the bleaching with chlorine in the first stage is converted into the bleaching with chlorine dioxide which is an ECF bleaching process.

14 Claims, No Drawings

PROCESS FOR BLEACHING CHEMICAL PULP WITH CHLORINE DIOXIDE, PEROXIDE AND $NA_2M_0O_4$ AS REACTION CATALYT

BACKGROUND OF THE INVENTION

1. Field of the Invention

The present invention relates to a process for treating chemical pulp for paper manufacturing. More particularly, the present invention relates to an improvement in the treatment for delignifying and bleaching chemical pulp.

2. Description of the Related Arts

Bleaching of chemical pulp for paper manufacturing is conducted by bleaching treatments in many stages. For the multi-stage bleaching, bleaching chemicals containing chlorine have heretofore been used. More specifically, the bleaching is conducted by combined use of chlorine (C), a hypochlorite (H), and chlorine dioxide (D), such as the combined use in a sequence of C—E—H—D, or C/D—E—H—E—D (C/D represents a stage of bleaching by the simultaneous use of chlorine and chlorine dioxide, and E represents a stage of extraction with an alkali).

However, toxic organic chlorine compounds detrimental to the environment are formed from the bleaching chemicals containing chlorine as by-products during the bleaching, and waste water containing the organic chlorine compounds discharged from the bleaching process causes an environmental problem. The organic chlorine compounds are generally analyzed and evaluated in accordance with the AOX method, such as METHOD No. 9020 of the United States Environmental Protection Agency.

For decreasing or preventing formation of organic chlorine compounds as by-products, it is most effective that the used amounts of chlorine chemicals are decreased or chlorine chemicals are not used at all. It is particularly effective that elementary chlorine is not used in the first stage. The pulp which is produced by this process is called an ECF (elementary chlorine free) pulp.

As the process for producing an ECF pulp from cooked pulp without bleaching with chlorine in the first stage, processes in which cooked chemical pulp is treated with an acid, and then the treated chemical pulp is bleached with hydrogen peroxide in an alkaline medium are disclosed in Japanese Patent Application Laid-Open No. Showa 51(1976)-102103 and Japanese Patent Application Laid-Open No. Showa 56(1981)-85489. A process in which chemical pulp bleached with oxygen in advance is treated with a chelating agent, and the treated chemical pulp is bleached with hydrogen peroxide or with a combination of hydrogen peroxide and oxygen in an alkaline medium is disclosed in Japanese Patent Application Laid-Open No. Heisei 3(1991)-27191. In the specifications of these applications, it is described that metals which cause waste in hydrogen peroxide by decomposition in the next stage of bleaching with hydrogen peroxide are removed by pretreatment of chemical pulp with an acid or a chelating agent, and delignification and bleaching in the stage using hydrogen peroxide can more efficiently be conducted. However, these processes have a drawback in that the processes are inferior in delignification although sufficient bleaching can be achieved by the processes. Therefore, another drawback arises in that the load in the bleaching in later stages is increased, and cost for bleaching and cost for treatment of waste water are increased.

The bleaching with hydrogen peroxide is inferior in delignification. As a process for solving this problem, processes using salts of molybdic acid as an activation catalyst in an acidic medium for activation of hydrogen peroxide are described in Journal of Pulp and Paper Science, Volume 18, No. 3, Pages 108 to 114 (1992) and in Journal of Japanese Association of Paper and Pulp Engineering, Volume 49, No. 3, Pages 88 to 92 (1995). However, these processes have a drawback in that increase in brightness is small although delignification by these processes is superior to that by the conventional process in which the treatment is conducted in an alkaline medium. These processes have another drawback in that cost of bleaching is increased because expensive hydrogen peroxide is used in a larger amount than that in the conventional process using chlorine.

Japanese Patent Publication Heisei 2(1990)-221482, Japanese Patent Publication Heisei 4(1992)-245988 and Japanese Patent Publication Heisei 6(1994)-207390 disclose that hemicellulase or xylanase is used in a process in which chemical pulp is further delignified after the chemical pulp has been bleached with oxygen to decrease the amount of bleaching agent containing chlorine used in later stages. However, this process has drawbacks in that viscosity of pulp is decreased by enzyme treatment, that yield of pulp is decreased, and that cost of bleaching is increased because the enzymes are very expensive.

Japanese Patent Publication Heisei 3(1991)-40888, Japanese Patent Publication Heisei 5(1993)-163691, and Japanese Patent Publication Heisei 5(1993)-302285 disclose processes in which the amount of a bleaching agent containing chlorine used in later stages is decreased by using ozone. However, these processes have drawbacks in that viscosity of pulp and yield of pulp are decreased by ozone although brightness is sufficiently increased, and that cost of bleaching is increased because ozone is very expensive.

As described in the above, the processes using hydrogen peroxide, the processes using an enzyme, and the processes using ozone have been proposed in order to avoid the use of chlorine and to decrease the used amount of bleaching agent containing chlorine. However, all these processes have the above drawbacks, and none of these agents are used as the main agent for the ECF bleaching.

In the United States and Europe, a process using chlorine dioxide in place of chlorine in the first stage is mainly conducted. This process has an advantage that the conversion into the ECF bleaching can be achieved simply by using chlorine dioxide which is a conventional bleaching agent in place of chlorine.

However, in order to convert the bleaching with chlorine in the first stage into the bleaching with chlorine dioxide, the capacity of an apparatus for generation of chlorine dioxide must be increased to 3 to 5 times as large as the capacity required for the conventional process. Thus, a drawback arises in that investment cost is increased. Moreover, when the bleaching in the first stage is conducted by using chlorine dioxide, decrease in the amount of discharged AOX is limited, and when further decrease in the amount of discharged AOX is required, it is impossible that the requirement is satisfied by this process.

SUMMARY OF THE INVENTION

Accordingly, the present invention has an object of suppressing formation of organic chlorine compounds as by-products and decreasing environmental toxicity in the waste water discharged from the bleaching process in the production of chemical pulp for paper manufacturing by decreasing the amount of chlorine dioxide used in the ECF bleaching process using chlorine dioxide in the first stage.

Another object of the present invention relates to the problem that increase in the capacity of an apparatus for producing chlorine dioxide is required when the bleaching with chlorine in the first stage is converted into the bleaching with chlorine dioxide which is an ECF bleaching process. Thus, the present invention has another object of providing a means for economically producing chemical pulp having a high degree of brightness in which increase in the capacity of an apparatus for producing chlorine dioxide is not required at all or suppressed to the minimum, and the investment cost is reduced to the minimum.

The present inventors discovered that, when pulp which has been cooked is treated by using chlorine dioxide, the efficiency of delignifying and bleaching the pulp is remarkably increased by additionally using a peroxide and a catalyst and treating the pulp simultaneously with chlorine dioxide, a peroxide, and a catalyst. The present invention has been completed on the basis of the discovery.

Thus, the present invention provides a process for bleaching chemical pulp for paper manufacturing comprising delignifying and bleaching chemical pulp which has been treated by cooking by simultaneous use of chlorine dioxide, a peroxide, and at least one reaction catalyst selected from the group consisting of oxoacids and heteropolyacids of elements of Groups IV, V and VI and salts of these acids. The present invention also provides a process for bleaching chemical pulp for paper manufacturing comprising delignifying and bleaching chemical pulp which has been treated with cooking by simultaneous use of chlorine dioxide, a peroxide, at least one reaction catalyst selected from the group consisting of oxoacids and heteropolyacids of elements of Groups IV, V and VI and salts of these acids, and a chelating agent. The present invention also provides a process for bleaching chemical pulp for paper manufacturing comprising removing metals from chemical pulp by pre-treatment with a chelating agent, delignifying and bleaching the treated chemical pulp by simultaneous use of chlorine dioxide, a peroxide, and at least one reaction catalyst selected from the group consisting of oxoacids and heteropolyacids of elements of Groups IV, V and VI and salts of these acids.

It was surprisingly discovered that, in accordance with the process of the present invention, simultaneous use of chlorine dioxide and a peroxide did not cause loss of chlorine dioxide or the peroxide by reaction between them, did not adversely affect the delignifying and bleaching effect, and resulted in an effect superior to the sum of the individual effects of the separate treatments by chlorine dioxide and the peroxide.

With respect to the problem that the decrease in the amount of discharged AOX is limited in the ECF bleaching using chlorine dioxide in the first stage and the problem that the capacity to generate chlorine dioxide is insufficient and a large increase in the capacity is required when the bleaching using chlorine in the first stage is converted into the bleaching using chlorine dioxide, the solution of these problems is made possible by the present invention. In accordance with the present invention, it is not necessary that a new bleaching tower is installed, and delignification and bleaching can be conducted by a conventional bleaching tower using chlorine or by a conventional bleaching tower using chlorine dioxide. Thus, chemical pulp having a high degree of brightness can economically be produced.

The process of the present invention is advantageously applied to bleaching of chemical pulp for paper manufacturing, particularly to delignification and bleaching of chemical pulp derived from broadleaf trees and needleleaf trees.

DESCRIPTION OF THE PREFERRED EMBODIMENTS

In the present invention, the process of the present invention may be directly applied to a chemical pulp which has been treated by cooking or may be applied to a chemical pulp which has been treated by cooking and then by bleaching with oxygen at a high temperature under a high pressure. (Hereinafter, the treatment with oxygen at a high temperature under a high pressure is occasionally referred to as O or O stage.)

When the treatment in O stage is conducted, the consistency of pulp, the temperature of the treatment, the time of the treatment, the amount of an alkali, the amount of oxygen, and the pressure of the treatment are adjusted to conventionally adopted conditions. For example, the above treatment is conducted under the following conditions: a consistency of pulp of 7 to 30%, preferably 10 to 20%; a temperature of the treatment of 60 to 1300° C., preferably 90 to 1100° C.; a time of the treatment of 20 to 150 minutes, preferably 30 to 90 minutes; an amount of an alkali calculated as that of NaOH of 0.5 to 6.0% by weight, preferably 1.0 to 3.0% by weight, based on the weight of absolutely dried pulp; an amount of oxygen of 0.5 to 5.0% by weight based on the weight of absolutely dried pulp; and a pressure of the treatment of 2.5 to 10 kg/cm$^2$ (gauge pressure), preferably 3.5 to 8 kg/cm$^2$ (gauge pressure).

The pulp treated in O stage is washed, dewatered, and then treated with chlorine dioxide (hereinafter, the treatment with chlorine dioxide is occasionally referred to as D or D stage), a peroxide (hereinafter, the treatment with a peroxide is occasionally referred to as P or P stage), a catalyst (hereinafter, the treatment with a catalyst is occasionally referred to as cat or cat stage) in the simultaneous presence of these agents. (Hereinafter, the treatment conducted in the simultaneous presence of these three agents is referred to as DPcat or DPcat stage.)

As the method of addition of the agents in DPcat stage of the present invention, chlorine dioxide, a peroxide, and a catalyst may be added to the pulp after mixing these agents in advance, or chlorine dioxide, a peroxide, and a catalyst may be added successively, the order of the addition being suitably selected as desired. As another method, chlorine dioxide may be added to the pulp, and a peroxide is added while chlorine dioxide is still remaining. In this case, a catalyst may be added simultaneously with chlorine dioxide or simultaneously with the peroxide.

The condition of DPeat stage can suitably be selected in accordance with the condition of the pulp. For example, the condition can be selected as follows: a consistency of pulp of 1 to 50%, preferably 2 to 30%; a temperature of bleaching of 30 to 120° C., preferably 40 to 95° C.; a time of the treatment of 5 to 360 minutes, preferably 15 to 240 minutes; and a pH of 3 or less.

The adjustment of pH in DPcat stage may be conducted by adjusting pH of the pulp with an acid in advance, or by adding an acid simultaneously with the addition of the agents of DPcat stage to adjust pH in the reaction. As the acid used for adjustment of pH, an inorganic acid is preferable, and sulfuric acid, nitric acid, hydrochloric acid, and a mixture of these acids are particularly preferable. Among these acids, sulfuric acid is most preferably used because sulfuric acid is available at a low price and has a low corrosive property.

The amount of chlorine dioxide is selected in the range of 0.01 to 3% by weight. As the peroxide used in DPcat stage, inorganic and organic peroxides, such as hydrogen peroxide, adducts of hydrogen peroxide and inorganic salts, sodium peroxide, performic acid, and peracetic acid, can be used. In general, hydrogen peroxide is preferably used.

The amount of the peroxide as that of the 100% peroxide is 0.01 to 5% by weight, preferably 0.05 to 3.0% by weight, based on the weight of the absolutely dried pulp.

It is preferred that metals are removed from the pulp by treating the pulp with a combination of a chelating agent and DPcat simultaneously in DPcat stage, or by treating the pulp with a chelating agent separately in a pre-treatment stage before the treatment of the pulp in DPcat stage. (Hereinafter, the pre-treatment with a chelating agent is occasionally referred to as Q or Q stage.) The pre-treatment with a chelating agent in the present invention is conducted, for example, under the following conditions: a consistency of pulp of 1 to 40% by weight, preferably 2 to 30% by weight, more preferably 5 to 20% by weight; a temperature of 10 to 180° C., preferably 20 to 120° C., more preferably 40 to 80° C.; a time of treatment of 15 to 300 minutes, preferably 30 to 180 minutes; and a pH of 2 to 12, preferably 3 to 11, more preferably 4 to 10. The pulp treated with a chelating agent in the pre-treatment stage is washed, and metals contained in the pulp are removed from the pulp.

When a chelating agent is added in DPcat stage, the chelating agent may be added in combination with D, in combination with P, or separately from DPcat. Any method of addition can be adopted as long as the chelating agent is present together with DPcat at the inlet of a bleaching tower. When the chelating agent is added in a pre-treatment stage before DPcat stage, the chelating agent may be added by any desired method as long as the pre-treatment of the pulp with the chelating agent can be conducted under the condition described above before the treatment with DPcat and metals in the pulp can subsequently be removed from the pulp. For example, the chelating agent may be added in one of the existing stages, such as the cooking stage, the bleaching stage using oxygen, and a tower containing a mixture of a high concentration before bleaching. The chelating agent may also be added in a stage newly inserted for treatment with a chelating agent.

The chelating agent used in the present invention is at least one type of chelating agent selected from the group consisting of aminocarboxylate chelating agents and aminoalkylphosphoric acid chelating agents represented by the general formula (1):

$$(X_2O_3PCH_2)_2.N.\{(CH_2)_m.N.CH_2PO_3X_2\}_{n.CH2}PO_3X_2 \quad (1)$$

wherein X represents hydrogen atom, ammonium group, or an alkali metal, m represents an integer of 2 or 3, and n represents an integer of 0 to 3.

More specific examples of the chelating agent include aminocarboxylate chelating agents, such as ethylenediaminetetraacetic acid (EDTA), diethylenetriaminepentaacetic acid (DTPA), N-hudroxyethylethylenediamine-N, N',N"-triacetic acid (HEDTA), nitrilotriacetic acid (NTA), cyclohexanediaminetetraacetic acid (CyDTA), and salts of these compounds; and aminoalkylphosphoric acid chelating agents, such as aminotrimethylenephosphonic acid (ATMP), ethylenediaminetetramethylenephosphonic acid (EDTMP), diethylene-triaminepentamethylenephosphonic acid (DTPMP), propylenediamine-tetramethylenephosphonic acid (PDTMP), dipropylenetriamine-pentamethylenephosphonic acid (DPTPMP), and salts of these compounds. The amount of the chelating agent is different depending on the amounts of heavy metals contained in the pulp and water used for the production. The amount is 0.01 to 5.0%, preferably 0.05 to 1.0%, based on the weight of the absolutely dried pulp.

As the reaction catalyst used in DPcat stage, an oxoacid of an element of Group IV, V, or VI, a salt thereof, a heteropolyacid containing an element of Group IV, V, or VI as the polyatom, or a salt thereof is used. Typical examples of the oxoacid and the salt thereof include various types of oxoacid of tungsten, molybdenum, vanadium, selenium, and titanium, and salts of these oxoacids. Examples of the salt include alkali metal salts, alkaline earth metal salts, and ammonium salts. At least one type of these compounds is used. Examples of the tungstic acid and the salts thereof include $H_2WO_4$ and sodium salt, calcium salt, and ammonium salt of $H_2WO_4$. Examples of molybdic acid and the salt thereof include $H_2MoO_4$, $H_2Mo_2O_7$, $H_6Mo_7O_{24}$, and sodium salts, calcium salts, and ammonium salts of these acids. Examples of the vanadic acid and the salt thereof include $HVO_3$, $H_3VO_4$, $H_4V_2O_7$, and sodium salts, calcium salts, and ammonium salts of these acids. Examples of the selenic acid and the salt thereof include $H_2SeO_4$ and sodium salt, calcium salt, and ammonium salt of $H_2SeO_4$. Examples of titanic acid and the salt thereof include $H_2TiO_3$, $H_4TiO_4$, and sodium salts, calcium salts, and ammonium salts of these acids.

Typical examples of the heteropolyacid and the salt thereof include heteropolyacids containing tungsten, molybdenum, or vanadium as the polyatom and salts of the heteropolyacids formed by replacing a part or all of the protons in the heteropolyacid with a cation. At least one type selected from these compounds is used. Examples of the salts formed by replacing a part or all of the protons in a heteropolyacid with a cation include salts of heteropolyacids containing alkali metals, alkaline earth metals, rare earth metals, and ammonium group. Examples of the heteropolyacids containing tungsten as the polyatom and the salt thereof include $H_3(PW_{12}O_{40})$, $H_3(AsW_{12}O_{40})$, $H_4(SiW_{12}O_{40})$, $H_4(TiW_{12}O_{40})$, $H_5(CoW_{12}O_{40})$, $H_5(FeW_{12}O_{40})$, $H_5(BW_{12}O_{40})$, $H_3(VW_{12}O_{40})$, $H_6(BeW_9O_{31})$, $H_6(TeW_6O_{41})$, $H_5(IW_6O_{24})$, $H_4(NiW_6O_{24}H_6)$, $H_3(GaW_6O_{24}H_6)$, $H_6(P_2W_{16}O_{62})$, $H_6(As_2W_{18}O_{62})$, $H_7(PW_{11}O_{33})$, and compounds obtained by cation exchange of these compounds with potassium, calcium, cerium, and ammonium group. Examples of the heteropolyacids containing molybdenum as the polyatom and the salt thereof include $H_3(PMo_{12}O_{40})$, $H_3(AsMo_{12}O_{40})$, $H_4(SiMo_{12}O_{40})$, $H_4(GeMo_{12}O_{40})$, $H_4(TiMo_{12}O_{40})$, $H_8(CeMo_{12}O_{42})$, $H_8(ThMo_{12}O_{42})$, $H_7(AsMo_{11}O_{39})$, $H_7(PMo_{11}O_{39})$, $H_8(GeMo_6O_{39})$, $H_6(MnMo_9O_{32})$, $H_6(NiMo_9O_{32})$, $H_6(TeMo_6O_{24})$, $H_5(IMo_6O_{24})$, $H_3(CoMo_6O_{24}H_6)$, $H_3(CrMo_6O_{24}H_6)$, $H_3(FeMo_6O_{24}H_6)$, $H_3(GaMo_6O_{24}H_6)$, $H_4(NiMo_6O_{24}H_6)$, $H_6(P_2Mo_{18}O_{62})$, $H_6(As_2Mo_{18}O_{62})$, and compounds obtained by cation exchange of these compounds with potassium, calcium, cerium, and ammonium group. Examples of the heteropolyacid containing vanadium as the polyatom and the salt thereof include $H_4(PW_{11}VO_{40})$, $H_4(PMo_{11}VO_{40})$, $H_5(PMo_{10}V_2O_{40})$, and compounds obtained by cation exchange of these compounds with potassium, calcium, cerium, and ammonium group.

The amount of the catalyst is different depending on the molecular weight of the catalyst and the conditions of the pulp treated with the delignification. The amount is 0.0001 to 1%, preferably 0.001 to 0.5%, based on the weight of the absolutely dried pulp.

The pulp treated in DPcat stage is treated with delignification and bleaching using a peroxide or a combination of a peroxide and oxygen of a medium to low pressure.

(Hereinafter, the treatment of bleaching using the peroxide is occasionally referred to as Ep or Ep stage. The treatment of bleaching using the combination of a peroxide and oxygen of a medium to low pressure is occasionally referred to as Eop or Eop stage.)

In Ep stage or Eop stage, the pulp is subject to delignification and bleaching with a peroxide or a combination of a peroxide and oxygen of a medium to low pressure in an alkaline medium. When the pulp is bleached with a combination of a peroxide and oxygen of a medium to low pressure, the peroxide and oxygen interact with the pulp substantially simultaneously.

As the alkali used for the alkaline medium in Ep stage or Eop stage, sodium hydroxide, potassium hydroxide, lime, or soda ash can be used. Among these agents, sodium hydroxide is preferably used because sodium hydroxide is inexpensive and the amount of sodium hydroxide used as supplement in the cooking stage can be decreased by recycling sodium hydroxide used in this stage into the cooking stage. The amount of the alkali calculated as that of sodium hydroxide is 0.1 to 6.0%, preferably 0.5 to 3.0%, based on the weight of the absolutely dried pulp. When the amount of the alkali is less than the specified range, the effect of delignification and bleaching is decreased. When the amount is more than the specified range, the viscosity of the pulp is significantly decreased.

As the oxygen used in Eop stage, oxygen gas and an air can be used, and oxygen gas is preferable. The amount of oxygen is preferably 0.1 to 1.0% based on the weight of the absolutely dried pulp. The pressure applied in Eop stage is preferably in the range of an atmospheric pressure to 3.5 $kg/cm^2$.

As the peroxide used in Ep stage or Eop stage, inorganic peroxides and organic peroxides, such as hydrogen peroxide, adducts of hydrogen peroxide and an inorganic salt, sodium peroxide, performic acid, and peracetic acid, can be used. In general, hydrogen peroxide is preferably used. The amount of the peroxide calculated as that of 100% hydrogen peroxide is preferably 0.05 to 8.0%, more preferably 0.2 to 3.0%, based on the weight of the absolutely dried pulp. When the amount of the peroxide is less than the specified range, the effect of delignification and bleaching is decreased. When the amount is more than the specified range, the efficiency of the peroxide is decreased.

As for the order of addition of the agents to the pulp in Ep stage or Eop stage, it is preferred that the alkali is added, and subsequently oxygen is added. It is also preferred that the peroxide is added after the addition of the alkali and immediately before, simultaneously with, or immediately after the addition of oxygen.

The consistency of the pulp in Ep stage or Eop stage of the present invention is preferably 7 to 30%, more preferably 10 to 20%. The temperature is preferably 40 to 120° C., more preferably 70 to 95° C. The time of the treatment is preferably 15 to 150 minutes, more preferably 30 to 120 minutes.

In Ep stage or Eop stage, a magnesium compound is additionally used. By the use of a magnesium compound, the effect of the peroxide on the delignification and bleaching is enhanced, and the decrease in viscosity of the pulp is reduced.

As the magnesium compound, magnesium sulfate, magnesium hydroxide, magnesium oxide, magnesium carbonate, and magnesium nitrate can be used. Magnesium sulfate is generally used. The amount of the magnesium compound calculated as that of the magnesium ion is preferably 0.005 to 0.75%, more preferably 0.01 to 0.3%, based on the weight of the absolutely dried pulp. As for the method of addition of the magnesium compound, it is preferred that the magnesium compound is added before the alkali, oxygen, and the peroxide are added.

The pulp obtained by DPcat-Ep(or Eop) or O-DPcat-Ep (or Eop) of the present invention has a considerably high degree of brightness without further treatment. (O-DPcat-Ep means the treatment by a sequence of O stage, DPcat stage, and Ep stage. A treatment by a sequence of stages is expressed in the same manner in the following.) However, a pulp having a still higher degree of brightness can be obtained by full bleaching in which a multi-stage bleaching is additionally conducted after the above processes has been conducted. In the full bleaching, bleaching using no or little chlorine or hypochlorite can be conducted because the pulp used in the full bleaching has already been delignified to a high degree in the later part of Ep stage or Eop stage, and the pulp has a high degree of brightness.

A full bleaching can be conducted in a sequence not using chlorine or a hypochlorite. For example, DPcat-Ep(or Eop)-D-P or O-DPcat-Ep(or Eop)-D-P can be conducted, wherein bleaching with chlorine dioxide (D) and then bleaching with a peroxide (P) are conducted after DPcat-Ep(or Eop) and O-DPcat-Ep(or Eop). By these processes, a pulp product having a high viscosity and a high degree of brightness which is as good as or superior to the pulp obtained in accordance with C/D-Eo-H-D or O-C/D-Eo-H-D can be obtained (Eo represents a stage in which oxygen of a medium to low pressure is simultaneously used in E stage). Moreover, bleaching can be achieved by generating remarkably smaller amounts of AOX than those generated by the conventional process because none of chlorine and hypochlorites are used.

The bleaching with chlorine dioxide in D stage in the present invention can be conducted under a condition conventionally adopted in D stage. For example, the bleaching can be conducted at a consistency of pulp in the range of 7 to 30% at a temperature in the range of 40 to 90° C. for a time in the range of 1 to 4 hours by using chlorine dioxide in an amount in the range of 0.1 to 2.0% based on the weight of the dried pulp.

The bleaching with a peroxide in P stage which follows the above stage is conducted under a condition conventionally adopted for beaching with a peroxide. The bleaching is conducted by using a peroxide in an alkaline medium at a consistency of pulp in the range of 7 to 30% at a temperature in the range of 40 to 100° C. for a time in the range of 1 to 4 hours. As the alkali used for the alkaline medium, sodium hydroxide, potassium hydroxide, lime, and soda ash are used, and in general, sodium hydroxide is preferably used. The amount of sodium hydroxide is selected in the range of 0.1 to 2% based on the weight of the dried pulp. As the peroxide, an inorganic or organic peroxide, such as hydrogen peroxide, an adduct of hydrogen peroxide and an inorganic salt, sodium peroxide, performic acid, and peracetic acid, can be used. In general, hydrogen peroxide is used. The amount of hydrogen peroxide calculated as that of 100% hydrogen peroxide is in the range of 0.1 to 3.0% based on the weight of the absolutely dried pulp.

When DPcat-Ep(or Eop) or O-DPcat-Ep(or Eop) of the present invention is conducted, the currently used apparatus for bleaching with chlorine may be used as the apparatus for bleaching with DPcat, or only a single apparatus is newly added as the apparatus for bleaching with DPcat. When the bleaching in the first stage is converted to the bleaching with chlorine dioxide (D) in order to convert the currently conducted bleaching with chlorine in the first stage into the ECF bleaching, an apparatus for generation of chlorine dioxide must be newly installed or the capacity of an existing apparatus for generation of chlorine dioxide must be increased because a large amount of chlorine dioxide is required. However, it is possible that the ECF bleaching is conducted by using a currently used apparatus for generation of chlorine dioxide when the treatment with DPcat is adopted.

When the full bleaching of the present invention, such as DPcat-Ep(or Eop)-D-P and O-DPcat-Ep(or Eop)-D-P, is conducted, the currently used apparatus for bleaching in D stage, P stage or E stage can be used without modification as the D stage and P stage in the later stages of the full bleaching, and no additional investment on the apparatus is necessary.

In the present invention, it is surprising that chlorine dioxide and the peroxide can simultaneously exist even though both chlorine oxide and the peroxide are oxidizing agents. It is also surprising that these agents can simultaneously exist even when the activity of the peroxide is enhanced by the addition of the catalyst.

It is not well understood why the effect superior to the effect obtained by the single use of chlorine dioxide or superior to the sum of the effects obtained by the combined used of chlorine dioxide and a peroxide is exhibited, in other words, why the synergistic effect is exhibited, when chlorine dioxide, a peroxide, and a catalyst are simultaneously used. It is considered that an intermediate substance formed by the reaction of chlorine dioxide and a peroxide works effectively for delignification and bleaching when the two oxidizing agents and a catalyst are simultaneously present in the system.

To summarize the advantages of the present invention, the bleaching which does not use chlorine can economically be achieved without expanding a currently used apparatus for generating chlorine dioxide or newly installing an apparatus for generating chlorine dioxide because, although the conversion of the current process into the ECF bleaching causes shortage in chlorine dioxide generated by the currently used apparatus for generating chlorine dioxide, the peroxide can make up the shortage. In accordance with the process of the present invention, a remarkably high degree of delignification can be achieved without causing decrease in viscosity. When the full bleaching is conducted, the amount of chlorine chemicals used in the added bleaching stages can be decreased to a great degree, and as the result, formation of organic chlorine compounds as by-products can be decreased to a great degree. Thus, it is industrially enabled that the environmental pollution with the waste water discharged from the bleaching process is decreased to a great degree.

The present invention is described more specifically with reference to examples in the following. The used amounts of ingredients are shown in terms of % by weight based on the weight of the absolutely dried pulp. The used amount of hydrogen peroxide is shown by the amount of 100% hydrogen peroxide. As the pulp, L pulp A obtained by kraft cooking of L pulp and L pulp B and L pulp C obtained each by cooking followed by bleaching with oxygen of L pulp were used. The analysis and the evaluation were conducted in accordance with the following methods.

Type of pulp

A: Hunter brightness, 32.0%; K value, 11.4; viscosity, 35.6 cp

B: Hunter brightness, 48.3%; K value, 6.6; viscosity, 22.5 cp

C: Hunter brightness, 48.3%; K value, 6.8; viscosity, 23.7 cp

Analysis and evaluation

Brightness: in accordance with the method of Japanese Industrial Standard P8123 (Method of Hunter Brightness)

K value: in accordance with K Value Method of TAPPI

Viscosity: in accordance with the method of J. TAPPI No. 44

AOX: in accordance with Method 9020, EPA, using TSX-10 type produced by MITSUBISHI CHEMICAL INDUSTRY Co., Ltd.

EXAMPLE 1

A dilute aqueous solution of sulfuric acid was added to L pulp A which had been treated by kraft cooking but had not been treated by bleaching, and pH of the resultant mixture was adjusted to 2. To the obtained mixture, 0.05% of $Na_2MoO_4$, 0.5% of $H_2O_2$, and 0.5% of $ClO_2$ were added, and the resultant mixture was treated under the condition of a consistency of pulp of 12% and a temperature of 70° C. for 2 hours.

After the reaction was finished, the reaction mixture was diluted with cool water to a consistency of pulp of 2.5%. The diluted mixture was dewatered to a consistency of pulp of 20%, and the procedures for the bleaching was finished.

EXAMPLE 2

Bleaching was conducted in accordance with the same procedures as those conducted in Example 1 except that L pulp B which had been bleached with oxygen after cooking was used, and 0.2% of $H_2O_2$ and 0.2 % of $ClO_2$ were used.

Comparative Example 1

Bleaching was conducted in accordance with the same procedures as those conducted in Example 1 except that none of $Na_2MoO_4$ and $H_2O_2$ were added.

Comparative Example 2

Bleaching was conducted in accordance with the same procedures as those conducted in Example 2 except that none of $Na_2MoO_4$ and $H_2O_2$ were added.

Comparative Example 3

Bleaching was conducted in accordance with the same procedures as those conducted in Example 1 except that $ClO_2$ was not added.

Comparative Example 4

Bleaching was conducted in accordance with the same procedures as those conducted in Example 2 except that $ClO_2$ was not added.

The results obtained in Examples 1 and 2 and Comparative Examples 1 to 4 are shown in Table 1.

TABLE 1

| | brightness (%) | K value | viscosity (cp) |
|---|---|---|---|
| Example 1 | 58.8 | 3.6 | 34.3 |
| Example 2 | 61.1 | 3.2 | 20.5 |
| Comparative Example 1 | 46.3 | 5.8 | 34.1 |
| Comparative Example 2 | 54.8 | 5.2 | 21.8 |
| Comparative | 38.7 | 6.4 | 31.1 |

TABLE 1-continued

| | brightness (%) | K value | viscosity (cp) |
|---|---|---|---|
| Example 3 Comparative Example 4 | 51.1 | 5.4 | 21.3 |

As can be understood from the results shown in Table 1, the effect obtained by the treatment with DPcat with respect to the brightness is not the simple sum of the effect of the treatment with D alone and the effect of the treatment with Pcat alone but a synergistic effect of the treatment with D and the treatment with Pcat.

EXAMPLES 3 to 6

Bleaching was conducted in accordance with the same procedures as those conducted in Example 2 except that $Na_2WO_4$, $Na_2TiO_4$, $Na_2SeO_4$, and $NaVO_3$ were used as the catalyst in DPcat stage in Examples 3, 4, 5, and 6, respectively, in place of $Na_2MoO_4$.

EXAMPLE 7 to 9

Bleaching was conducted in accordance with the same procedures as those conducted in Example 2 except that $Na_3(PW_{12}O_{40})$, $Na_3(PMo_{12}O_{40})$, and $Na_4(PW_{11}VO_{40})$ were used as the catalyst in DPcat stage in Examples 7, 8, and 9, respectively, in place of Na2MoO4.

The results obtained in Examples 7 to 9 are shown in Table 2.

TABLE 2

| | brightness (%) | K value | viscosity (cp) |
|---|---|---|---|
| Example 3 | 60.8 | 3.3 | 20.3 |
| Example 4 | 61.1 | 3.2 | 20.5 |
| Example 5 | 60.3 | 3.5 | 20.1 |
| Example 6 | 62.8 | 2.9 | 20.8 |
| Example 7 | 59.7 | 3.6 | 20.1 |
| Example 8 | 61.8 | 3.1 | 20.6 |
| Example 9 | 60.7 | 3.2 | 20.4 |

EXAMPLES 10 to 12

Bleaching was conducted in accordance with the same procedures as those conducted in Example 2 except that pH in the initial period of the bleaching in DPcat stage was adjusted to 1, 2, or 3 in Examples 10, 11, and 12, respectively. Comparative Examples 5 to 8

Bleaching was conducted in accordance with the same procedures as those conducted in Example 2 except that pH in the initial period of the bleaching in DPcat stage was adjusted to 4, 6, 8 or 10 in Comparative Examples 5, 6, 7, and 8, respectively.

The results obtained in Examples 10 to 12 and Comparative Examples 5 to 8 are shown in Table 3.

TABLE 3

| | initial pH of bleaching | brightness (%) | K value | viscosity (cp) |
|---|---|---|---|---|
| Example 10 | 1.2 | 61.3 | 3.1 | 20.3 |
| Example 11 | 2.3 | 61.1 | 3.2 | 20.5 |
| Example 12 | 2.9 | 61.5 | 3.3 | 20.1 |
| Comparative Example 5 | 3.8 | 57.8 | 4.6 | 20.8 |
| Comparative Example 6 | 6.2 | 56.7 | 5.2 | 21.1 |
| Comparative Example 7 | 8.1 | 54.8 | 5.7 | 21.6 |
| Comparative Example 8 | 10.3 | 52.3 | 6.1 | 21.8 |

EXAMPLE 13

To the pulp obtained in Example 2, 0.25% of $MgSO_4$, 1.2% of NaOH, and 1.0% of $H_2O_2$ were added, and the resultant mixture was treated under the condition of a consistency of pulp of 12% and a temperature of 90° C. for 90 minutes.

After the reaction was finished, the reaction mixture was diluted with cool water to a consistency of pulp of 2.5%. The diluted mixture was dewatered to a consistency of pulp of 20%, and a bleached pulp was obtained.

EXAMPLE 14

Bleaching was conducted in accordance with the same procedures as those conducted in Example 13 except that the following operation was conducted during the bleaching with $H_2O_2$: after 0.5% of oxygen was added and the pressure was increased to 2 kg/cm$^2$, the pressure was reduced to an atmospheric pressure in 90 minutes while the temperature was kept constant.

Comparative Example 9

Bleaching was conducted in accordance with the same procedures as those conducted in Example 13 except that the pulp obtained in Comparative Example 2 was used, and 1.0% of $H_2O_2$ was used.

Comparative Example 10

Bleaching was conducted in accordance with the same procedures as those conducted in Example 14 except that the pulp obtained in Comparative Example 2 was used, and 1.0% of $H_2O_2$ was used.

The results obtained in Examples 13 and 14 and Comparative Examples 9 and 10 are shown in Table 4.

TABLE 4

| | after DPcat | | after Ep or Eop | |
|---|---|---|---|---|
| | brightness (%) | K value | brightness (%) | K value |
| Example 13 | 61.1 | 3.2 | 80.6 | 2.4 |
| Example 14 | 61.1 | 3.2 | 82.3 | 2.0 |
| Comparative | 54.8 | 5.2 | 74.6 | 3.2 |

TABLE 4-continued

| | after DPcat | | after Ep or Eop | |
|---|---|---|---|---|
| | brightness (%) | K value | brightness (%) | K value |
| Example 9 | | | | |
| Comparative Example 10 | 54.8 | 5.2 | 76.2 | 2.8 |

As can be understood from the above results, the effect of the treatment with $H_2O_2$ conducted after the treatment with DPcat was superior to the effect of the treatment with $H_2O_2$ conducted after the treatment with D with respect to the brightness and the delignification.

EXAMPLE 15

1) A dilute aqueous solution of sulfuric acid was added to L pulp C which had been bleached with oxygen after the cooking, and pH of the resultant mixture was adjusted to 2. To the obtained mixture, 0.05% of $Na_2MoO_4$, 0.2% of $H_2O_2$, and 0.2% of $ClO_2$ were added, and the resultant mixture was treated under the condition of a consistency of pulp of 12% and a temperature of 70° C. for 2 hours.

After the reaction was finished, the reaction mixture was diluted with cool water to a consistency of pulp of 2.5%, and then dewatered to a consistency of pulp of 20%.

2) To the pulp obtained in the above, 0.25% of $MgSO_4$, 1.2% of NaOH, and 0.2% of $H_2O_2$ were added, and the resultant mixture was treated under the condition of a consistency of pulp of 12% and a temperature of 90° C. for 90 minutes. After the reaction was finished, the reaction mixture was diluted with cool water to a consistency of pulp of 2.5%, and then dewatered to a consistency of pulp of 20% to obtain a bleached pulp.

EXAMPLE 16

Bleaching was conducted in accordance with the same procedures as those conducted in Example 15 except that 0.05% of $Na_2MoO_4$, 0.2% of $H_2O_2$, 0.2% of $ClO_2$, and 0.1% of DTPA were simultaneously used.

EXAMPLE 17

Bleaching was conducted in accordance with the same procedures as those conducted in Example 15 except that, after the pulp was treated with 0.1% of DTPA in advance under the conditions described below, the treated pulp was treated with 0.05% of $Na_2MoO_4$, 0.2% of $H_2O_2$, and 0.2% of $ClO_2$.

1) Treatment with the chelating agent under the condition of an amount of DTPA of 0.1%, a consistency of pulp of 5%, a temperature of 45° C., a time of 60 minutes, and a pH of 6.

2) Dilution of the pulp treated with the chelating agent to a consistency of pulp of 2.5%, and dewatering of the resultant mixture to a consistency of pulp of 20% to obtain a pulp used for treatment with DPcat.

EXAMPLE 18

The same procedures as those conducted in Example 17 was conducted except that DTPMP was used as the chelating agent.

Comparative Example 11

The same procedures as those conducted in Example 17 was conducted except that none of $Na_2MoO_4$ and $H_2O_2$ were added.

Comparative Example 12

The same procedures as those conducted in Example 17 was conducted except that $ClO_2$ was not added.

The results obtained in Examples 15 to 18 and Comparative Examples 11 and 12 are shown in Table 5.

TABLE 5

| | after DPcat | | after Ep | |
|---|---|---|---|---|
| | brightness (%) | K value | brightness (%) | K value |
| Example 15 | 62.2 | 3.4 | 72.7 | 2.6 |
| Example 16 | 63.6 | 2.7 | 73.5 | 2.2 |
| Example 17 | 64.2 | 2.3 | 74.3 | 1.7 |
| Example 18 | 64.5 | 2.2 | 74.6 | 1.6 |
| Comparative Example 11 | 54.4 | 5.5 | 66.3 | 3.8 |
| Comparative Example 12 | 51.6 | 5.1 | 59.1 | 4.5 |

As can be understood from the above results, the brightness and the effect of delignification were further increased by simultaneously using a chelating agent in DPcat stage or by treating with a chelating agent in advance before DPcat stage.

Comparative Example 13

Pulp was treated by the bleaching sequence of Q-D-Pcat-Ep under the following conditions.

1) Q (treatment with a chelating agent): The pulp was treated under the same condition as that in the pre-treatment with a chelating agent in Example 17.

2) D (bleaching with chlorine dioxide): the pulp was treated with 0.2% of $ClO_2$ under the condition of a consistency of pulp of 12% and a temperature of 70° C. for 2 hours; and after the reaction was finished, the reaction mixture was diluted with cool water to a consistency of pulp of 2.5% and then dewatered to a consistency of pulp of 20% to prepare a pulp for bleaching in the next stage.

3) Pcat (bleaching with P and cat): pH was adjusted to 2 by addition of a dilute aqueous solution of sulfuric acid to the pulp which had been treated with D; to the resultant mixture, 0.05% of $Na_2MoO4$ and 0.2% of $H_2O_2$ were added; and the obtained mixture was treated under the condition of a consistency of pulp of 12% and a temperature of 70° C. for 2 hours.

After the reaction was finished, the reaction mixture was diluted with cool water to a consistency of pulp of 2.5% and then dewatered to a consistency of pulp of 20% to prepare a pulp for bleaching in the next stage.

4) Ep (bleaching with hydrogen peroxide): to the pulp obtained in the above, 0.25% of $MgSO_4$, 1.2% of NaOH, and 0.2% of $H_2O_2$ were added; and the resultant mixture was treated under the condition of a consistency of pulp of 12% and a temperature of 90° C. for 90 minutes.

After the reaction was finished, the reaction mixture was diluted with cool water to a consistency of pulp of 2.5% and then dewatered to a consistency of pulp of 20% to obtain a bleached pulp.

Comparative Example 14

Pulp was treated by the bleaching sequence of Q-Pcat-D-Ep under the same conditions as those in Comparative Example 13.

The results obtained in Comparative Examples 13 and 14 are shown in Table 6 together with the results obtained in Example 17.

TABLE 6

| | after DPcat, Pcat or D | | after Ep | |
|---|---|---|---|---|
| | brightness (%) | K value | brightness (%) | K value |
| Example 17 | 64.2 | 2.3 | 74.3 | 1.7 |
| Comparative Example 13 | 59.3 | 2.6 | 69.7 | 2.1 |
| Comparative Example 14 | 60.2 | 2.5 | 70.3 | 2.0 |

As can be understood from the results, the effect of bleaching with DPcat was superior to the effect of bleaching with D and Pcat separately with respect to the brightness and the delignification. Especially regarding the brightness, the effect of bleaching with DPcat was much superior.

EXAMPLE 19

The pulp obtained in Example 13 was bleached with chlorine dioxide (D) and then with hydrogen peroxide under the following conditions.

D (bleaching with chlorine dioxide)

1) Consistency of pulp, 13%; temperature, 70° C.; time, 2 hours; $ClO_2$, 0.2%.

2) After the reaction was finished, the reaction mixture was diluted with cool water to a consistency of pulp of 2.5% and then dewatered to a consistency of pulp of 20%. The obtained product was used for bleaching in the next stage.

P (bleaching with hydrogen peroxide)

Consistency of pulp, 13%; temperature, 70° C.; time, 2 hours; NaOH, 0.2%; and $H_2O_2$, 0.2%.

EXAMPLE 20

The pulp obtained in Example 14 was bleached under the same conditions as those in Example 19.

Comparative Example 15

A conventional process for bleaching was conducted. By using L pulp B, bleaching was conducted in the sequence of C/D-Eo-H-D under the generally used conditions.

1. C./D (bleaching with chlorine and chlorine dioxide)

To L pulp which had been kraft cooked and then bleached with oxygen, 1.2% of an aqueous solution of chlorine and chlorine dioxide (the fraction of effective chlorine replaced with chlorine dioxide, 10%) was added, and the resultant mixture was treated under the condition of a consistency of pulp of 4% and a temperature of 40° C. for 60 minutes.

After the treatment was finished, the resultant mixture was diluted with cool water to a consistency of pulp of 2.5% and then dewatered to a consistency of pulp of 22%. By adding an aqueous solution of sodium hydroxide to the obtained mixture, pH was adjusted to 7, and the consistency of pulp was adjusted to 20%.

2. Eo (treatment with alkali in combination with oxygen)

To the pulp obtained in the above, 0.6% of $MgSO_4$ and 1% of sodium hydroxide were added. After the consistency of pulp was adjusted to 10% and the temperature was adjusted to 90° C., 0.5% of oxygen was added, and the pressure was increased to 2 kg/cm$^2$. Then, the pressure was reduced to an atmospheric pressure in 90 minutes while the other conditions were kept constant.

After the treatment was finished, the resultant mixture was diluted with cool water to a consistency of pulp of 2.5% and then dewatered to a consistency of pulp of 20%.

3. H (bleaching with sodium hypochlorite)

To the pulp obtained in the above, sodium hypochlorite was added in such an amount that 0.3% of the available chlorine is contained, and the resultant mixture was treated at a consistency of pulp of 10% at a temperature of 45° C. for 2 hours.

After the treatment was finished, the resultant mixture was diluted with cool water to a consistency of pulp of 2.5% and then dewatered to a consistency of pulp of 20%.

4. D (bleaching with chlorine dioxide)

To the pulp obtained in the above, chlorine dioxide was added in such an amount that 0.2% of chlorine dioxide was contained, and the resultant mixture was treated under a condition of a consistency of pulp of 13% and a temperature of 70° C. for 3 hours.

After the treatment was finished, the resultant mixture was diluted with cool water to a consistency of pulp of 2.5% and then dewatered to a consistency of pulp of 20%.

The bleached pulps obtained in Examples 19 and 20 and Comparative Example 15 were analyzed and evaluated, and the amount of organic chlorine compounds (AOX) per 1 ton of a bleached pulp contained in the whole waste water discharged from the bleaching stages was also measured. The results are shown in Table 7.

TABLE 7

| | evaluation of bleached pulp | | analysis of waste water from bleaching |
|---|---|---|---|
| | brightness (%) | K value | AOX (kg/pt) |
| Example 19 | 86.7 | 15.2 | 0.21 |
| Example 20 | 87.5 | 14.2 | 0.20 |
| Comparative Example 15 | 86.2 | 13.2 | 1.46 |

What is claimed is:

1. A process for bleaching chemical pulp for paper manufacturing comprising delignifying and bleaching chemical pulp which has been treated by cooking, the delignifying and bleaching being carried out by contacting the chemical pulp simultaneously with chlorine dioxide, a peroxide and a reaction catalyst, said reaction catalyst being $Na_2MoO_4$, and wherein the bleaching is carried out at a pH of 3 or less.

2. The process for bleaching chemical pulp for paper manufacturing according to claim 1 which further comprises contacting the chemical pulp with a chelating agent simultaneously used in addition to the chlorine dioxide, the peroxide, and the at least one reaction catalyst.

3. The process for bleaching chemical pulp for paper manufacturing according to claim 2, wherein the chelating agent is at least one selected from the group consisting of an aminocarboxylate and an aminoalkylphosphoric acid, represented by the formula (1):

$$(X_2O_3PCH_2)_2.N.\{(CH_2)_m.N.CH_2PO_3X_2\}_n.CH_2PO_3X_2 \quad (1)$$

wherein X represents a hydrogen atom, an ammonium group, or an alkali metal, m represents an integer of 2 or 3, and n represents an integer of 0 to 3.

4. The process for bleaching chemical pulp for paper manufacturing according to claim 3 wherein the chelating agent is selected from the group consisting of ethylenediaminetetraacetic acid, diethylenetriaminepentaacetic acid, N-hydroxyethylethylenediamine-N, N',N", triacetic acid, nitrilotriacetic acid, cyclohexanediaminetetraacetic acid, aminotrimethylenephosphonic acid, ethylenediaminetetramethylenephosphonic acid, diethylenetriaminepentamethylenephosphonic acid, propylenediaminetetramethylenephosphonic acid and dipropylenetriaminepentamethylenephosphonic acid, and the chelating agent is in an amount of 0.01 to 5.0% based on the weight of dried pulp.

5. The process for bleaching chemical pulp for paper manufacturing according to claim 1 which further comprises prior to the delignifying and bleaching, removing metals from the chemical pulp which has been treated by cooking, by treatment of the chemical pulp with a chelating agent.

6. The process for bleaching chemical pulp for paper manufacturing according to claim 1, wherein the chemical pulp before the delignification and bleaching has a pH of 1 to 3.

7. The process for bleaching chemical pulp for paper manufacturing according to claim 1, wherein the bleaching is carried out with oxygen at a high temperature under a high pressure.

8. The process for bleaching chemical pulp for paper manufacturing according to claim 7, wherein the temperature is 60 to 130° C.; the pressure is 2.5 to 10 kg/cm$^2$; the oxygen is in an amount of 0.5 to 5.0% by weight, based on the weight of dried pulp; and the bleaching is carried out for 20 to 150 minutes.

9. The process for bleaching chemical pulp for paper manufacturing according to claim 1 which further comprises contacting the resultant delignified and bleached chemical pulp with a peroxide or with a combination of a peroxide and oxygen in an alkaline medium.

10. The process for bleaching chemical pulp for paper manufacturing according to claim 9, wherein the alkaline medium contains an alkali selected from the group consisting of sodium hydroxide, potassium hydroxide, lime and soda ash; the alkali is in an amount of 0.1 to 6.0%, based on the weight of dried pulp; and the oxygen is in an amount of 0.1 to 1.0%, based on the weight of dried pulp.

11. The process for bleaching chemical pulp for paper manufacturing according to claim 10 which further comprises contacting the resultant delignified and bleached chemical pulp with a magnesium compound selected from the group consisting of magnesium hydroxide, magnesium oxide, magnesium carbonate and magnesium nitrate; and the magnesium compound being in an amount of 0.005 to 0.75%, calculated as a magnesium ion, based on the weight of dried pulp.

12. The process for bleaching chemical pulp for paper manufacturing according to claim 1 which further comprises contacting the resultant delignified and bleached chemical pulp with a peroxide or with a combination of a peroxide and oxygen in an alkaline medium, and then contacting the resultant chemical pulp with chlorine dioxide and subsequently with a peroxide.

13. The process for bleaching chemical pulp for paper manufacturing according to claim 1, wherein the reaction catalyst is in an amount of 0.0001 to 1%, based on the weight of dried pulp.

14. The process for bleaching chemical pulp for paper manufacturing according to claim 1, wherein the chlorine dioxide is in an amount of 0.01 to 3% by weight and the peroxide is hydrogen peroxide and is in an amount of 0.01 to 5% by weight, based on the weight of dried pulp.

* * * * *